US010458614B2

(12) United States Patent
Kim et al.

(10) Patent No.: US 10,458,614 B2
(45) Date of Patent: Oct. 29, 2019

(54) LAMP FOR VEHICLE

(71) Applicant: SL Corporation, Daegu (KR)

(72) Inventors: Jongwoon Kim, Gyeongsangbuk-do (KR); Nakjung Choi, Gyeongsangbuk-do (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 16/037,217

(22) Filed: Jul. 17, 2018

(65) Prior Publication Data

US 2019/0186706 A1 Jun. 20, 2019

(30) Foreign Application Priority Data

Dec. 14, 2017 (KR) ..... 10-2017-0172199

(51) Int. Cl.

| | |
|---|---|
| ***F21S 41/265*** | (2018.01) |
| ***F21S 41/20*** | (2018.01) |
| ***F21S 41/143*** | (2018.01) |
| ***F21S 41/40*** | (2018.01) |
| *F21S 41/43* | (2018.01) |

(52) U.S. Cl.

CPC ..... *F21S 41/285* (2018.01); *F21S 41/143* (2018.01); *F21S 41/265* (2018.01); *F21S 41/40* (2018.01); *F21S 41/43* (2018.01)

(58) Field of Classification Search

CPC ..... F21S 41/285; F21S 41/40; F21V 5/007; F21V 5/008; F21V 5/043

See application file for complete search history.

(56) References Cited

U.S. PATENT DOCUMENTS

| | | | | |
|---|---|---|---|---|
| 5,515,253 | A * | 5/1996 | Sjobom | B60Q 1/503 257/E33.067 |
| 2006/0215401 | A1 | 9/2006 | Menzel et al. | |
| 2014/0092619 | A1 | 4/2014 | Bushre | |
| 2016/0033101 | A1* | 2/2016 | Yan | F21S 41/143 362/520 |
| 2017/0241605 | A1* | 8/2017 | Yamamoto | F21S 41/338 |
| 2017/0241606 | A1* | 8/2017 | Courcier | G02B 27/0025 |

(Continued)

FOREIGN PATENT DOCUMENTS

| | | | |
|---|---|---|---|
| CN | 1948821 | A | 4/2007 |
| DE | 639774 | C | 12/1936 |

(Continued)

*Primary Examiner* — Julie A Bannan

(74) *Attorney, Agent, or Firm* — Mintz Levin Cohn Ferris Glovsky and Popeo, P.C.; Kongsik Kim; Jhongwoo Jay Peck

(57) ABSTRACT

Provided is a lamp for a vehicle capable of forming a beam pattern satisfying the performance requirements by using a micro lens optical system which includes a cylinder lens. The lamp includes a light source portion, a first lens portion which includes a plurality of micro incident lenses, and a second lens portion which includes a plurality of micro exit lenses disposed in front of the plurality of micro incident lenses. Particularly, the lamp forms a beam pattern using a combination of one or more micro incident/exit units. Each of the micro incident/exit units includes one cylinder lens and a plurality of corresponding lenses that correspond to the one cylinder lens, and any one of the micro incident lens or the micro exit lens is the cylinder lens and the other is the corresponding lens.

22 Claims, 18 Drawing Sheets

(56) References Cited

U.S. PATENT DOCUMENTS

| | | | | |
|---|---|---|---|---|
| 2017/0241607 | A1* | 8/2017 | Courcier | F21S 41/143 |
| 2018/0010756 | A1 | 1/2018 | Knittel et al. | |
| 2018/0106450 | A1* | 4/2018 | Kamau | F21V 5/002 |
| 2019/0072252 | A1 | 3/2019 | Moser et al. | |

FOREIGN PATENT DOCUMENTS

| | | | |
|---|---|---|---|
| DE | 102005013950 | A1 | 9/2006 |
| DE | 102016112617 | B3 | 10/2017 |
| JP | 2016-534503 | A | 11/2016 |
| KR | 200160014 | Y1 | 11/1999 |
| KR | 10-2017-0112530 | A | 10/2017 |
| WO | 2017066818 | A1 | 4/2017 |

* cited by examiner

LAMP FOR VEHICLE

CROSS-REFERENCE TO RELATED APPLICATION

This application claims priority from Korean Patent Application No. 10-2017-0172199 filed on Dec. 14, 2017, the disclosure of which is incorporated herein by reference in its entirety.

BACKGROUND

1. Field of the Disclosure

The present disclosure relates to a lamp for a vehicle, and more particularly, a lamp for a vehicle, which is capable of forming a beam pattern which is configured as a micro optical system and satisfies light distribution performance requirements.

2. Description of the Related Art

Generally, a vehicle includes a variety of types of lamps having an illumination function for recognizing an object disposed proximate to the vehicle during low light conditions (e.g., night) and a signaling function for informing other vehicles or road users proximate to the vehicle of a driving state of the vehicle.

For example, a headlamp, a fog lamp, and the like generally have the illumination function. A turn signaling lamp, a tail lamp, a brake lamp, a side marker lamp, and the like generally have the signaling function. Also, installation criteria and specifications for the lamps for a vehicle are regulated by law so that each lamp can adequately perform its function.

Recently, studies for reducing a size of a lamp for a vehicle by using a micro lens having a relatively short focal distance have been actively performed.

Among lamps for a vehicle, a headlamp, which forms a low beam pattern or a high beam pattern to ensure a front field of vision for a driver during nighttime driving, performs an important function for driving safety.

In order to ensure an adequate field of vision by a headlamp, it is necessary to satisfy light distribution performance including a light amount, light efficiency, or the like. A method of satisfying the light distribution performance requirements without adding an additional component to a lamp for a vehicle is required.

The above information disclosed in this section is merely for enhancement of understanding of the background of the disclosure and therefore it may contain information that does not form the prior art that is already known in this country to a person of ordinary skill in the art.

SUMMARY

Aspects of the present disclosure provide a lamp for a vehicle capable of forming a beam pattern, which satisfies the requirements for the light distribution performance, by adjusting combinations and arrangements of micro incident/exit units which form an incident/exit area.

It should be noted that objects of the present disclosure are not limited to the above-described objects, and other objects of the present disclosure will be apparent to those skilled in the art from the following descriptions.

According to some aspects of the present disclosure, a lamp for a vehicle may include a light source portion, a first lens portion with a plurality of micro incident lenses onto which light generated by the light source portion is incident, and a second lens portion with a plurality of micro exit lenses disposed in front of the plurality of micro incident lenses. Also, the lamp may form a beam pattern using a combination of one or more micro incident/exit units. Here, each of the micro incident/exit units may include one cylinder lens which extends in a first direction and a plurality of corresponding lenses corresponding to the one cylinder lens, and any one of the micro incident lens and the micro exit lens may be the cylinder lens and the other may be the corresponding lens.

The plurality of corresponding lenses may be arranged in the direction in which the cylinder extends. Here, when the cylinder lens is the micro incident lens, light which exits from the cylinder lens may be incident onto the corresponding lens. Conversely, when the cylinder lens is the micro exit lens, light which exits from the corresponding lens may exit toward the cylinder lens.

Light which exits from the lamp may form a beam pattern which is widened in the first direction and/or a beam pattern which is narrowed in a second direction perpendicular to the first direction.

When the cylinder lens is the micro incident lens, an incident surface thereof may include a refraction portion which is bent at both ends of the first direction. When the cylinder lens is the micro exit lens, an exit surface thereof may include a refraction portion which is bent at both ends of the first direction. In particular, the light which is incident onto or exits from the refraction portion may be narrowed in the first direction.

In some exemplary embodiments, the micro incident/exit units of a same configuration, in which the one cylinder lens is combined with the same number of the corresponding lenses, may be arranged adjacently.

The lamp may include first micro incident/exit units in which the one cylinder lens is combined with the two corresponding lenses. Here, the first micro incident/exit units may be arranged in an optical axis area to increase a brightness of a high illuminance area of the beam pattern.

The micro incident/exit units, in which the one cylinder lens is combined with the three or more corresponding lenses, may be arranged outside an optical axis area and may form a spread area of the beam pattern.

In the micro incident/exit units, the one cylinder lens may be combined with N number of the corresponding lenses. The micro incident/exit units may include a first micro incident/exit unit whose N number is 2, a second micro incident/exit unit whose N number is 3, and a third micro incident/exit unit whose N number is 4.

The first micro incident/exit units may be arranged in an optical axis area to increase a brightness of a high illuminance area of the beam pattern. The second micro incident/exit units may be symmetrically arranged in a second direction perpendicular to the first direction with respect to an optical axis to form a part of a spread area of the beam pattern. The third micro incident/exit units may be symmetrically arranged in the first direction with respect to an optical axis to form a part of a spread area of the beam pattern.

In the first lens portion, the plurality of micro incident lenses may be formed on a surface of a first transmission portion transmitting light, which faces the light source portion. In the second lens portion, the plurality of micro exit lenses may be formed on a surface of a second light transmission portion transmitting light, from which light exits. The first light transmission portion and the second light transmission portion may be disposed to abut each other.

The lamp may further include a shielding portion with a plurality of shields disposed on rear focal points of the plurality of micro exit lenses to obstruct a portion of light which is incident onto the plurality of micro exit lenses. Particularly, the plurality of shields may be disposed on and fixed to a surface of the second light transmission portion which faces the first light transmission portion.

The first light transmission portion may have a thickness corresponding to a focal distance of the micro incident lens, and the second light transmission portion may have a thickness corresponding to a focal distance of the micro exit lens.

Further, the light source portion may include a light source and a light guide portion configured to guide the light generated by the light source to the first lens portion by adjusting an optical path of the light to be parallel to an optical axis of the light source. Also, the light guide portion may be one of a Fresnel lens and a collimator lens.

In the lamp, at least two of the micro incident/exit units may have different numbers of the plurality of corresponding lenses that correspond to the one cylinder lens.

Details of other examples are included in a detailed description and drawings.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
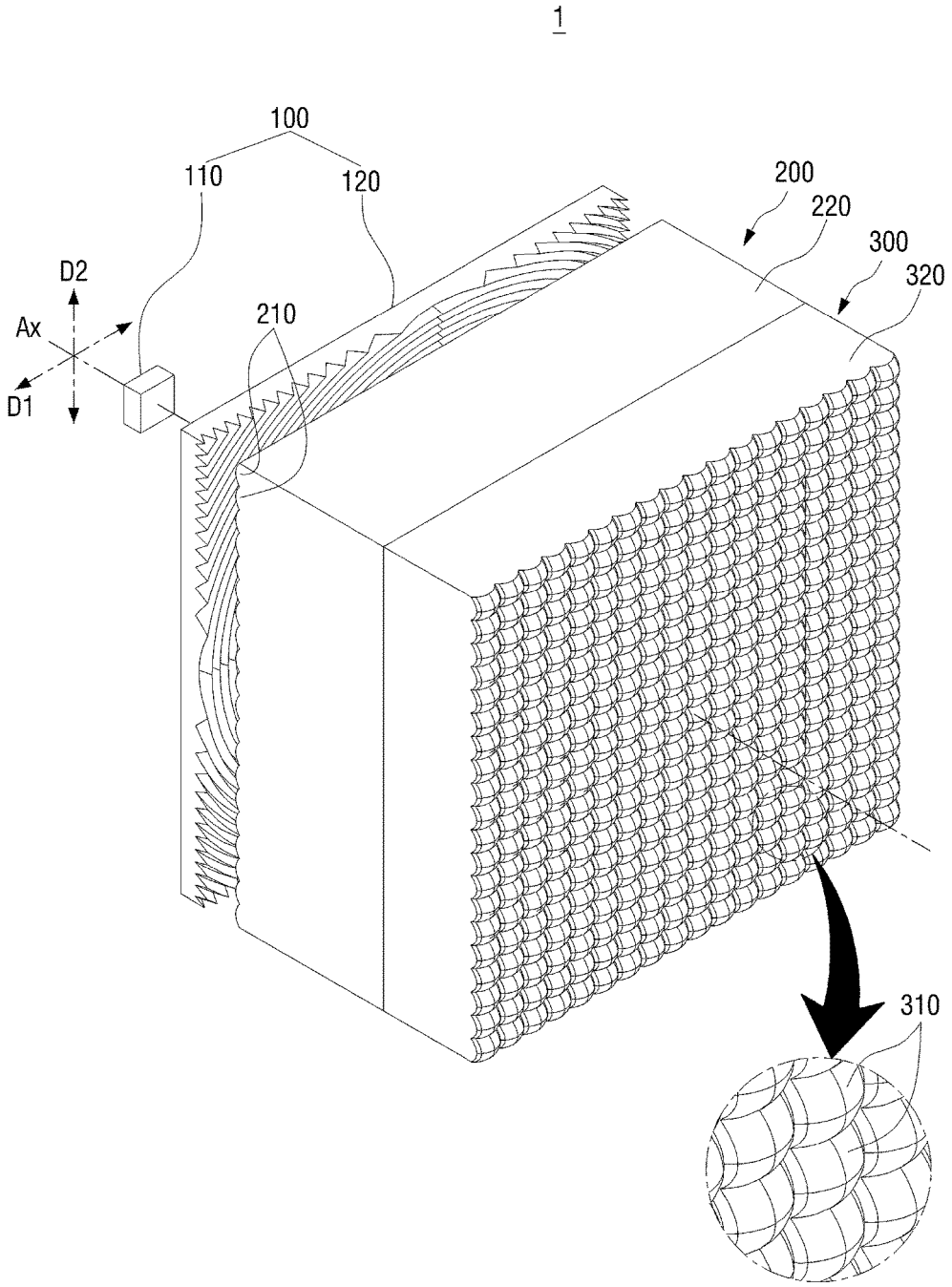
FIGS. 1 and 2 are perspective views of a lamp for a vehicle according to some exemplary embodiments of the present disclosure.

Advantages and features of the present disclosure and a method of achieving the same will become apparent with reference to the attached drawings and embodiments described below in detail. However, the present disclosure is not limited to the embodiments described below and may be embodied with a variety of different modifications. The embodiments are merely provided to allow one of ordinary skill in the art to completely understand the scope of the present disclosure and are defined by the scope of the claims. Throughout the specification, like reference numerals refer to like elements.

Accordingly, in some embodiments, well-known operations of a process, well-known structures, and well-known technologies will be not described in detail to avoid obscuring of understanding the present disclosure.

The terms used herein are for explaining embodiments but are not intended to limit the present disclosure. Throughout the specification, unless particularly defined otherwise, singular forms include plural forms. The terms "comprises" and/or "comprising" are used herein as meanings which do not exclude presence or addition of one or more other components, stages, and/or operations in addition to stated components, stages, and/or operations. Also, "and/or" includes each and one or more combinations of stated items.

Also, embodiments disclosed herein will be described with reference to perspective views, cross-sectional views, side views, and/or schematic diagrams which are exemplary views of the present disclosure. Accordingly, modifications may be made in the forms of exemplary views by manufacturing technology, allowable error, and/or the like. Accordingly, the embodiments of the present disclosure will not be limited to particular forms shown in the drawings and include changes made by a manufacturing process. Also, throughout the drawings of the present disclosure, components may be slightly exaggerated or reduced in consideration of convenience of description.

Hereafter, a lamp 1 for a vehicle according to some exemplary embodiments of the present disclosure will be described with reference to the drawings.

Figure 2:
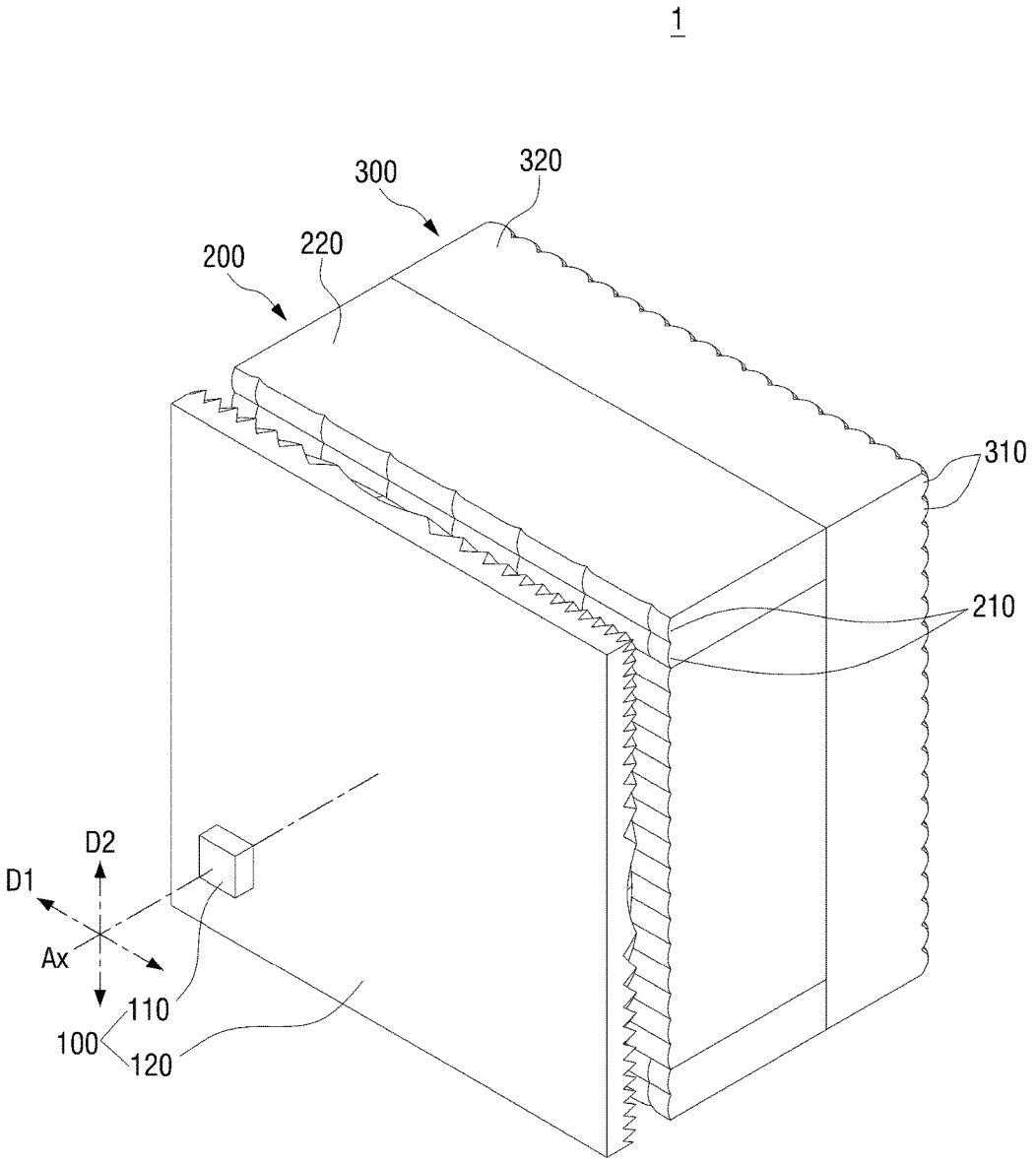
Figure 3:
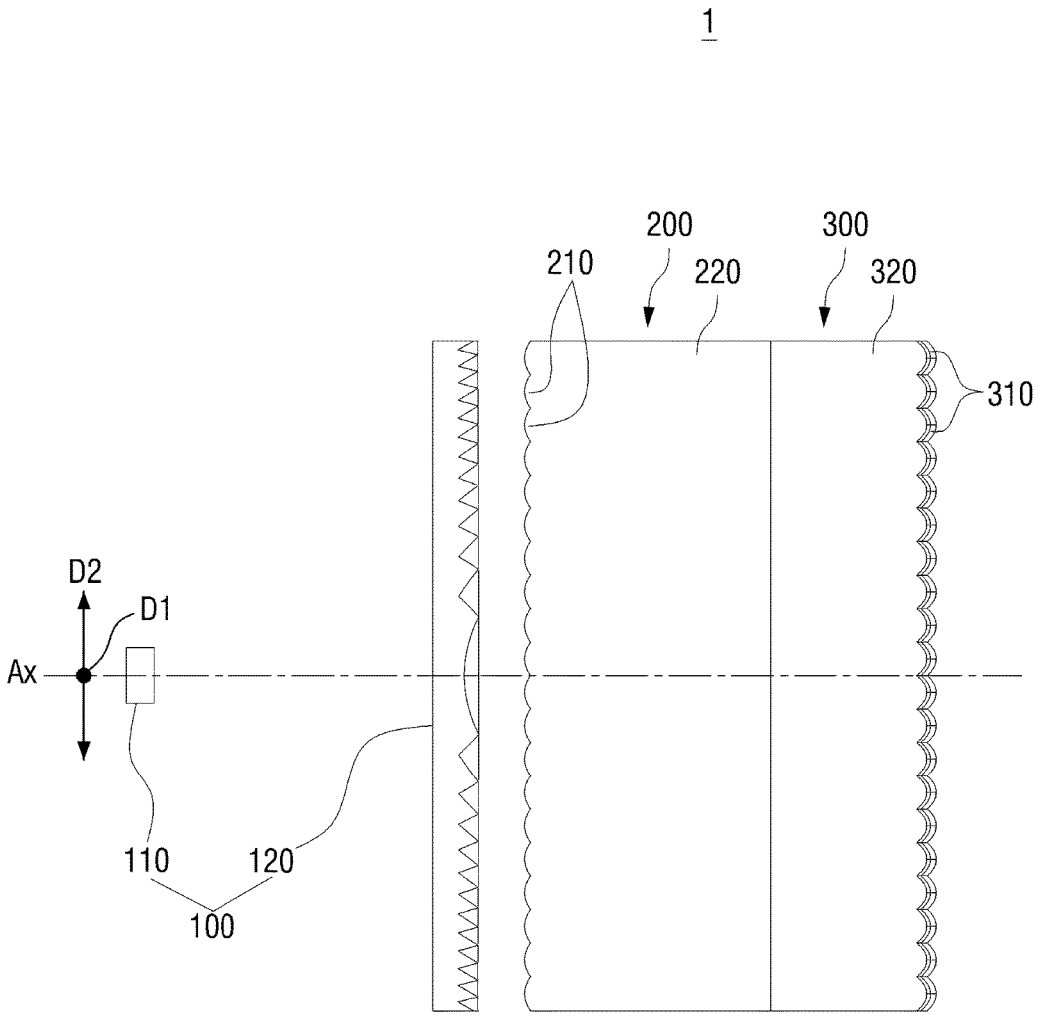
FIG. 3 is a side view of the lamp for the vehicle according to some exemplary embodiments of the present disclosure.
Figure 4:
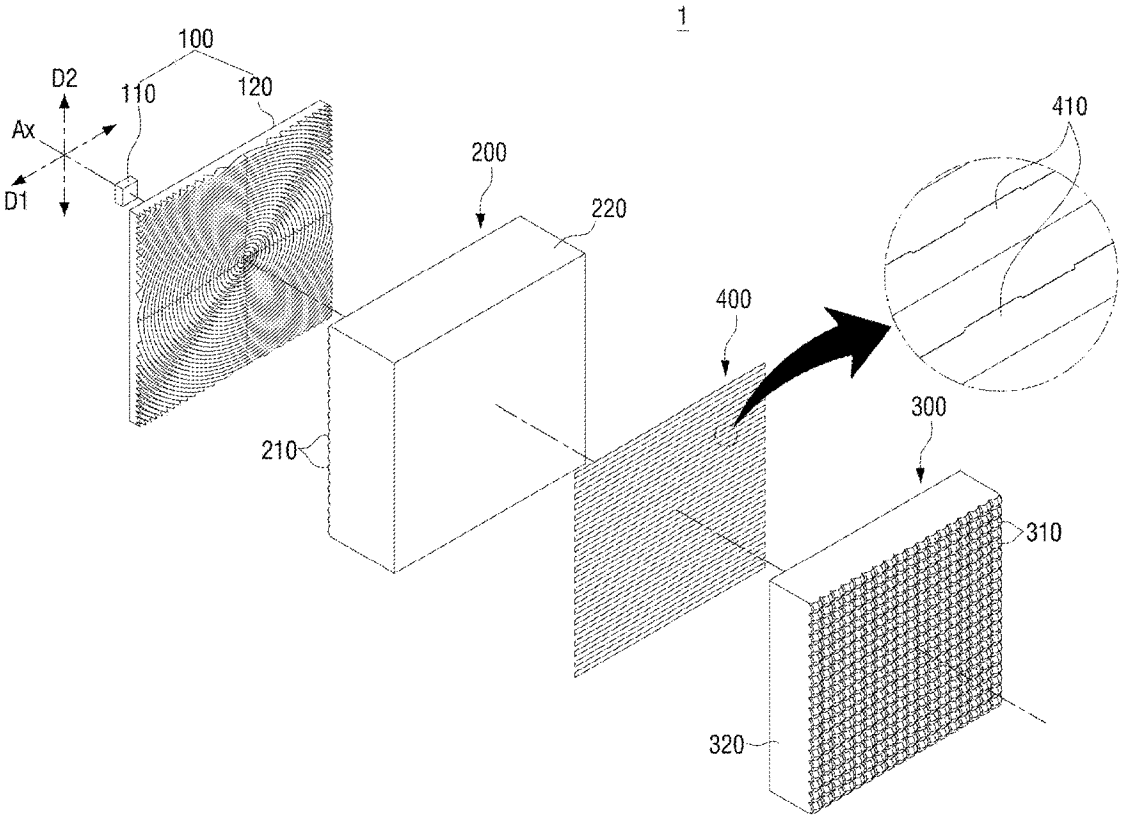
FIGS. 4 and 5 are exploded-perspective views of the lamp for the vehicle according to some exemplary embodiments of the present disclosure.
Figure 5:
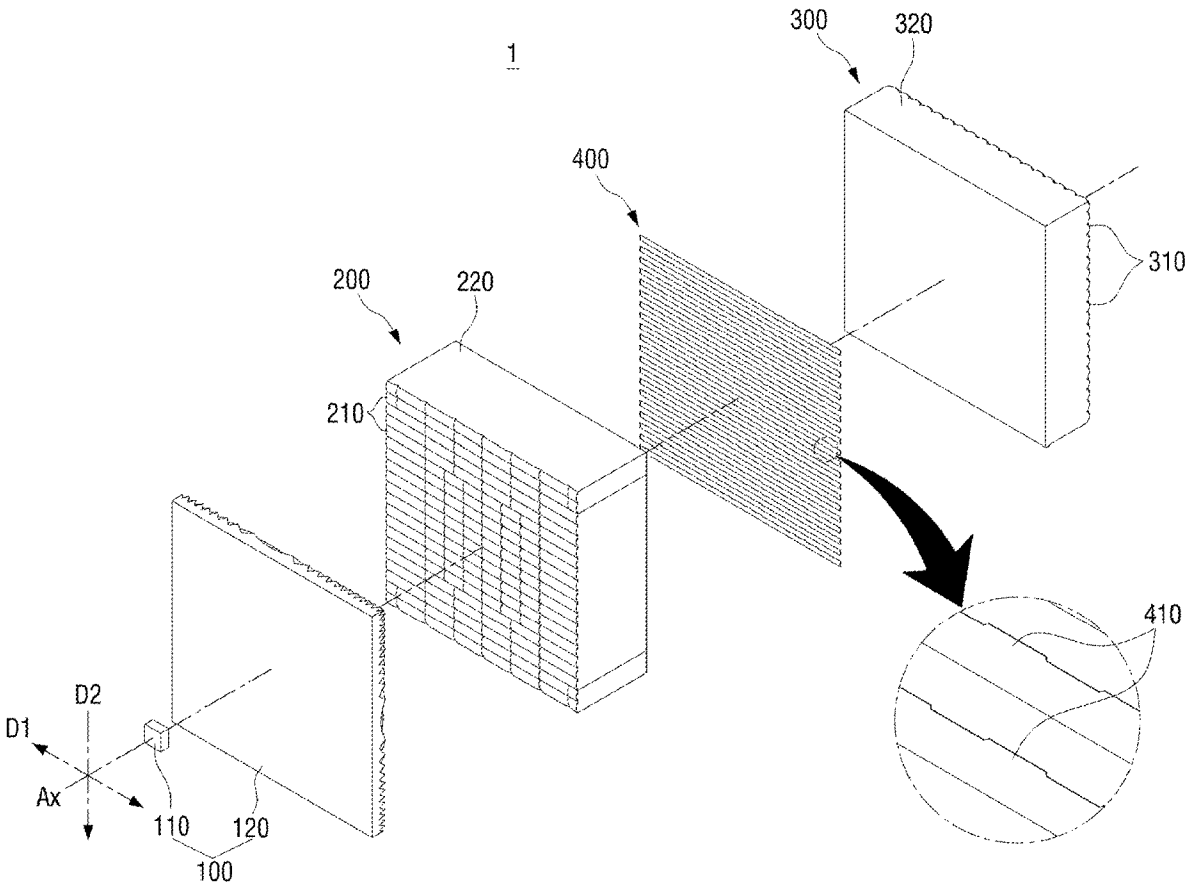

FIGS. 1 and 2 are perspective views of the lamp 1 according to some exemplary embodiments of the present disclosure, FIG. 3 is a side view of the lamp 1 according to some exemplary embodiments of the present disclosure, and FIGS. 4 and 5 are exploded perspective views of the lamp 1 according to some exemplary embodiments of the present disclosure.

Referring to FIGS. 1 to 5, the lamp 1 according to some exemplary embodiments of the present disclosure may include a light source portion 100, a first lens portion 200, a second lens portion 300, and a shielding portion 400.

In the exemplary embodiments of the present disclosure, the lamp 1 may be a headlamp for ensuring a front field of vision in a vehicle when the vehicle is traveling during low light conditions (e.g., night) by emitting light in a driving direction or through a dark place such as a tunnel and the like, but is not limited thereto. The lamp 1 may be used not only as a headlamp, but also as any of a variety of lamps installed in a vehicle such as a tail lamp, a brake lamp, a fog lamp, a position lamp, a turn-signal lamp, a daytime running lamp, a backup lamp, and the like.

Additionally, the exemplary embodiments of the present disclosure will be described regarding the lamp 1 as a headlamp that forms a low beam pattern having a certain cut-off line CL to prevent a driver of a vehicle in front or a vehicle approaching in an opposite lane from being blinded, but it is merely an example for aiding in understanding the present disclosure. Therefore, the present disclosure is not limited thereto, and a variety of beam patterns may be formed according to use of the lamp 1 according to some exemplary embodiments of the present disclosure. Components included in the lamp 1 according to some exemplary embodiments of the present disclosure may be added, deleted, or changed based on each of the beam patterns.

The light source portion 100 may include a light source 110 and a light guide portion 120.

In the exemplary embodiments of the present disclosure, a semiconductor light emitting diode (LED) such as an LED lamp may be used as the light source 110. However, the light source 110 is not limited thereto, and a variety of types of light sources such as a bulb and the like may be used as the light source 110 in addition to the semiconductor LED.

The light guide portion 120 may guide light generated by the light source 110 at a certain light irradiation angle, to the first lens portion 200 by adjusting an optical path of the light to be parallel to an optical axis Ax of the light source 110. The optical axis Ax of the light source 110 may represent a line which passes a center of a light emitting surface of the light source 110 perpendicularly.

The light guide portion 120 may reduce the light loss by allowing the light generated by the light source 110 to be incident onto the first lens portion 200 as much as possible and allow the light which is incident onto the first lens portion 200 to be uniformly incident onto the first lens portion 200 overall by adjusting the optical path of the light to be parallel to the optical axis Ax of the light source 110.

In the exemplary embodiments of the present disclosure, a Fresnel lens configured as a lens having a shape of plural rings may be used as the light guide portion 120 to reduce a thickness thereof and to adjust the optical path of the light generated by the light source 110 to be parallel to the optical axis Ax of the light source 110. However, the present disclosure is not limited thereto, and a variety of types of lenses such as a collimator lens and the like capable of adjusting the optical path of the light generated by the light source 110 may be used as the light guide portion 120.

The first lens portion 200 may include a plurality of micro incident lenses 210 onto which the light generated by the light source portion 100 is incident. Incident surfaces of the plurality of micro incident lenses 210 may collectively form an incident surface of the first lens portion 200, and exit surfaces of the plurality of micro incident lenses 210 may collectively form an exit surface of the first lens portion 200.

In the exemplary embodiments of the present disclosure, the plurality of micro incident lenses 210 may be formed on a surface of a first light transmission portion 220 that is made of a light transmission material, which faces the light source portion 100. However, the first light transmission portion 220 is intended to form the first lens portion 200 and the second lens portion 300 as a single body and may be omitted when the first lens portion 200 and the second lens portion 300 are formed separately.

The second lens portion 300 may include a plurality of micro exit lenses 310. Incident surfaces of the plurality of micro exit lenses 310 may collectively form an incident surface of the second lens portion 300, and exit surfaces of the plurality of micro exit lenses 310 may collectively form an exit surface of the second lens portion 300.

In the exemplary embodiments of the present disclosure, the plurality of micro exit lenses 310 may be formed on a surface of a second light transmission portion 320 that is made of a light transmission material from which light exits. However, the second light transmission portion 320 may be omitted for similar reasons as described above in regards to the first lens portion 200.

Meanwhile, the lamp 1 according to some exemplary embodiments of the present disclosure may include a combination of one or more micro incident/exit units and may form a beam pattern. In particular, each of the micro incident/exit units may include one semicylinder lens (hereinafter, referred to as "a cylinder lens") and a plurality of corresponding lenses.

In other words, the micro incident/exit unit may include one cylinder lens and a plurality of corresponding lenses. In particular, any one of the micro incident lens 210 and the micro exit lens 310 may be the cylinder lens and the other may be the corresponding lens.

Accordingly, in the cylinder lens and the plurality of corresponding lenses, which form one micro incident/exit unit, when the cylinder lens is the micro incident lens 210, the light which exits from the cylinder lens may be incident onto the micro exit lens 310 which is the corresponding lens. On the other hand, when the cylinder lens is the micro exit lens 310, the light may exit toward the cylinder lens from the corresponding lens, which is the micro incident lens 210.

The cylinder lens may have a semicircular cross section and may extend in length in one direction to have an overall shape obtained by cutting a cylinder in half along a longitudinal direction. The cylinder lens may include one or a plurality of arranged lens having a semicylindrical shape which extends in one direction, and a focal line which connects focal points F may be formed along the direction in which the length of the cylinder lens extends. Meanwhile, a curved surface of the cylinder lens may be a spherical surface or an aspherical surface such as a parabolic surface or a hyperboloid which deviates from a spherical surface.

Also, in the exemplary embodiments of the present disclosure, a first direction D1 in which the cylinder lens extends lengthwise may be a horizontal direction which is parallel to a line H-H on a screen toward which a beam pattern is emitted, and a second direction D2 may be a vertical direction perpendicular to the optical axis Ax and the first direction D1. However, the first direction D1 and the second direction D2 may be varied depending on the directions in which the lamp 1 is disposed and the cylinder lens extends.

In the exemplary embodiments of the present disclosure, each of the plurality of micro incident lenses 210 may be the cylinder lens having a semicylindrical shape which extends lengthwise in the first direction D1, and the plurality of micro incident lenses 210 may be arranged in the second direction D2 which is perpendicular to the first direction D1.

Figure 6:
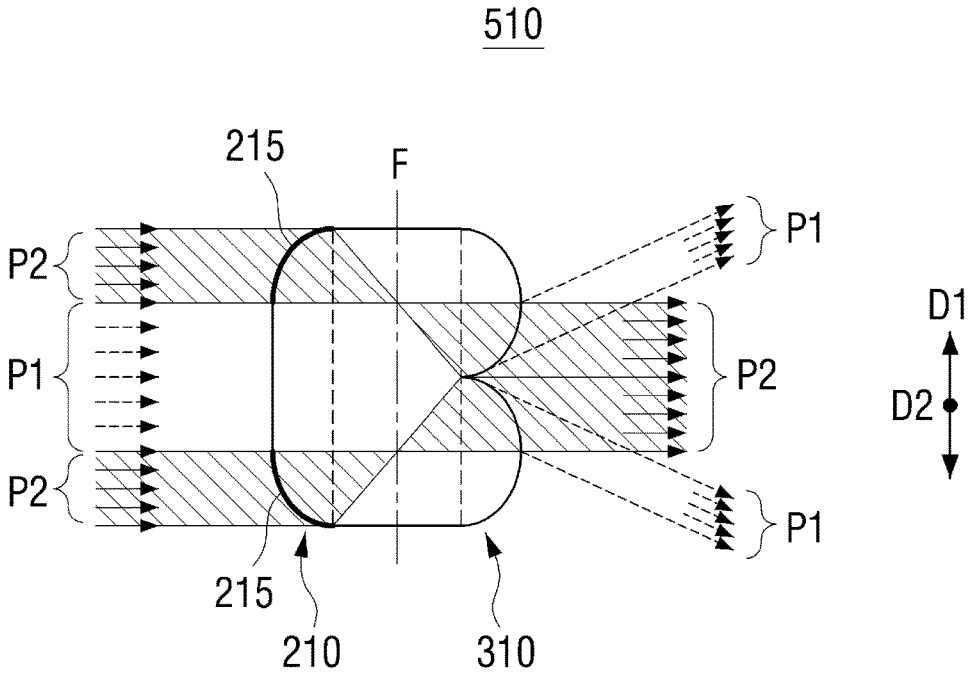
FIGS. 6 to 8 are views illustrating first to third micro incident/exit units and light-proceeding paths with respect to a first direction according to some exemplary embodiments of the present disclosure.
Figure 7:
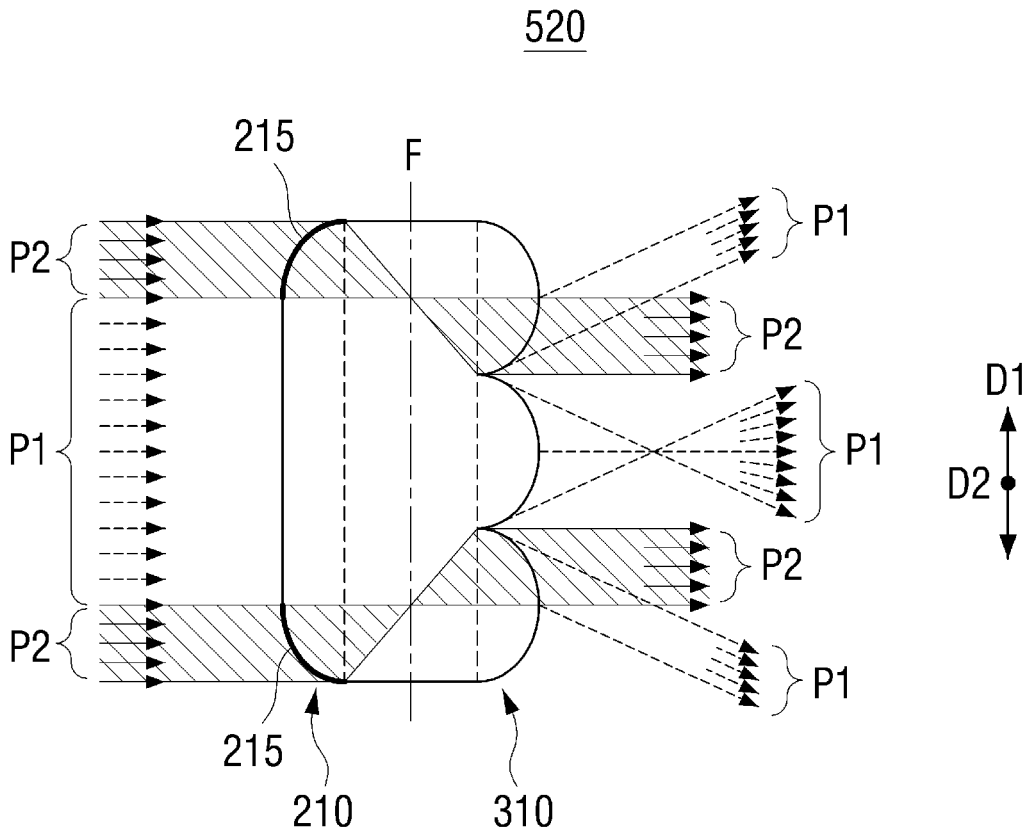
Figure 8:
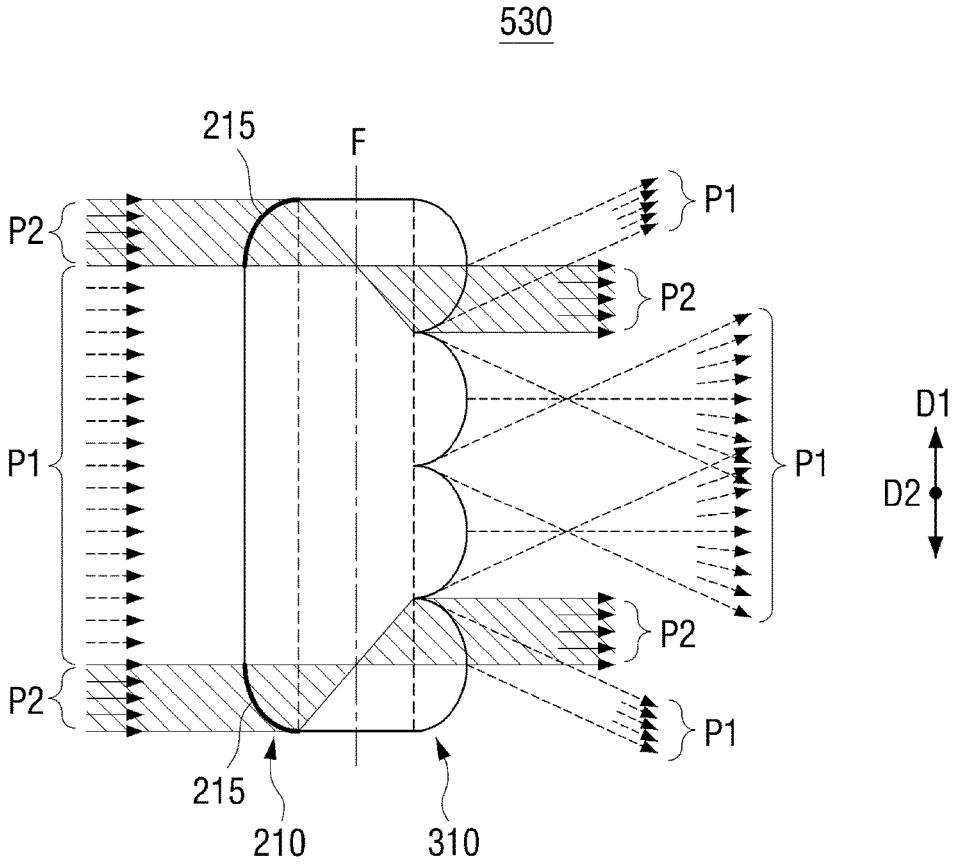

FIGS. 6 to 8 are views illustrating first to third micro incident/exit units 510, 520, and 530 and light-proceeding paths with respect to the first direction D1 according to some exemplary embodiments of the present disclosure.

As described above, each of the plurality of micro incident lenses 210 may be the cylinder lens having a semicylindrical shape which extends in the first direction D1, and one or more micro exit lenses 310 corresponding to the one cylinder lens may be arranged in the first direction D1 in which the cylinder lens extends.

In other words, the micro incident/exit unit according to some exemplary embodiments of the present disclosure may include N number of corresponding lenses arranged in the first direction D1 per one cylinder lens. Here, the micro incident lenses 210 or the micro exit lenses 310 may be combined, with N being a natural number.

Referring to FIGS. 6 to 8, according to some exemplary embodiments of the present disclosure, the first micro incident/exit unit 510 may include one cylinder lens combined with two micro exit lenses 310, the second micro incident/exit unit 520 may include one cylinder lens combined with three micro exit lenses 310, and the third micro incident/exit unit 530 may include one cylinder lens combined with four micro exit lenses 310.

Referring to FIGS. 6 to 8, in the micro incident/exit unit according to some exemplary embodiments of the present disclosure, the light that is generated by the light source portion 100 and is incident onto and exits from the cylinder lens may be incident onto one or more micro exit lenses 310 combined with the cylinder lens.

In particular, a portion of the light which is incident onto or exits from the micro exit lens 310 may form a beam pattern which is widened in the first direction D1 in which the cylinder lens extends. Specifically, referring to FIGS. 6 to 8 for a first beam pattern P1 shown therein, the first beam pattern P1 which is incident from the light guide portion 120 in parallel may be refracted from an exit surface of each of the micro exit lenses 310 toward a front focal point of each of the micro exit lenses 310 and subsequently widened in the first direction D1.

Here, the front may be a direction in which light is emitted by the lamp 1 according to some exemplary embodiments of the present disclosure and may vary based on a position or a direction in which the lamp 1 according to some exemplary embodiments of the present disclosure is installed.

As described above, a beam pattern in which the light which is incident onto the cylinder lens may be widened to be parallel to the line H-H of a low beam pattern LP such that it has an effect of reducing costs of configuring the micro incident lens 210 and the micro exit lens 310, which may be arranged to be parallel to the line H-H, in comparison to a case of including general micro incident lenses.

In addition, a portion of the light which is incident onto and exits from the micro exit lens 310 may form a beam pattern which is narrowed in the first direction D1. In detail, referring to FIGS. 6 to 8 for the first to third micro incident/exit units 510, 520, and 530 shown therein, an incident surface of the cylinder lens may include a refraction portion 215 which refracts a path of incident light, which is incident to be parallel to the optical axis Ax, in the first direction D1.

The refraction portion 215 may be bent at the incident surface of the cylinder lens toward both ends of the first direction D1 to be formed as an aspherical surface. Referring to FIGS. 6 to 8 for a second beam pattern P2 shown therein, the second beam pattern P2 which is incident from the light guide portion 120 in parallel may have a path refracted toward a rear focal point F of the micro exit lens 310 opposite the refraction portion 215 in the first direction D1.

The second beam pattern P2, which is refracted and proceeds, may exit from the exit surface of the micro exit lens 310 in parallel and may be narrowed more in the first direction D1 than an original incident area of the cylinder lens.

Here, the refraction portion 215 of the cylinder lens according to some exemplary embodiments of the present disclosure may be formed to allow the second beam pattern P2 which is incident in parallel onto the refraction portion 215 to have a focal point F and a curvature with a path refracted in the first direction D1 toward the rear focal point F of the micro exit lens 310.

Further, any configuration may be applied in which a front focal point F of the micro incident lens 210 and the rear focal point F of the micro exit lens 310 according to some exemplary embodiments of the present disclosure may be formed in positions corresponding to each other, and the second beam pattern P2 may form a beam pattern which is narrowed in the first direction D1 through the refraction portion 215.

Figure 9:
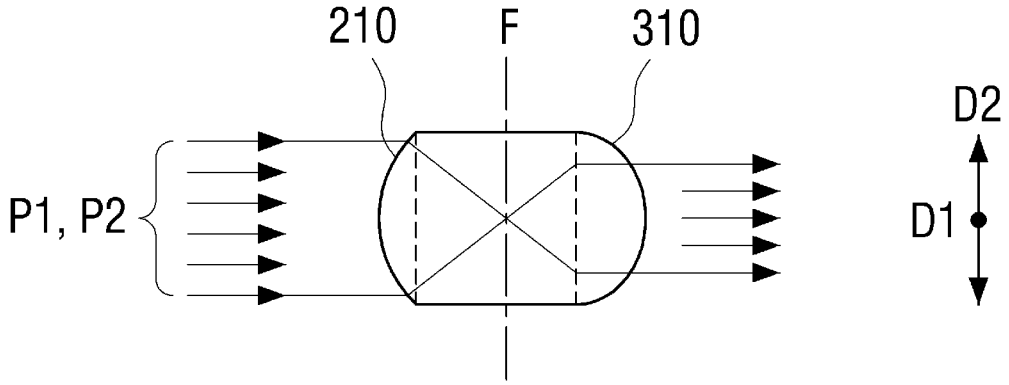
FIG. 9 is a view illustrating light-proceeding paths of the micro incident/exit units with respect to a second direction according to some exemplary embodiments of the present disclosure.

Meanwhile, the light which is incident onto and exits from the cylinder lens may form a beam pattern which is narrowed in the second direction D2. FIG. 9 is a view illustrating light-proceeding paths of the micro incident/exit unit with respect to the second direction D2 according to some exemplary embodiments of the present disclosure.

Referring to FIG. 9, the micro incident lens 210 according to some exemplary embodiments of the present disclosure may be the cylinder lens which extends in the first direction D1 such that a semicircular-shaped cross section is formed in the second direction D2.

Accordingly, the first and second beam patterns P1 and P2, which are incident onto in parallel the optical axis Ax from the light guide portion 120, may be refracted and proceed in the second direction D2 toward a front focal point F of the cylinder lens on the incident surface of the cylinder lens and may exit to be parallel from the exit surface of the micro exit lens 310.

In particular, focal distances of the cylinder lens and the micro exit lens 310 or curvatures of the cylinder lens and the micro exit lens 310 with respect to the second direction D2 may be formed to be the same. However, when the focal distance of the cylinder lens is longer than the focal distance of the micro exit lens 310 or the curvature of the micro exit lens 310 is formed to be relatively greater than that of the cylinder lens, the first and second beam patterns P1 and P2 may form a beam pattern which is narrowed in the second direction D2.

Accordingly, the lamp 1, according to some exemplary embodiments of the present disclosure, may form a beam pattern which is widened in the first direction D1 and narrowed in the second direction D2 through a combination of the first to third micro incident/exit units 510, 520, and 530.

Figure 10:
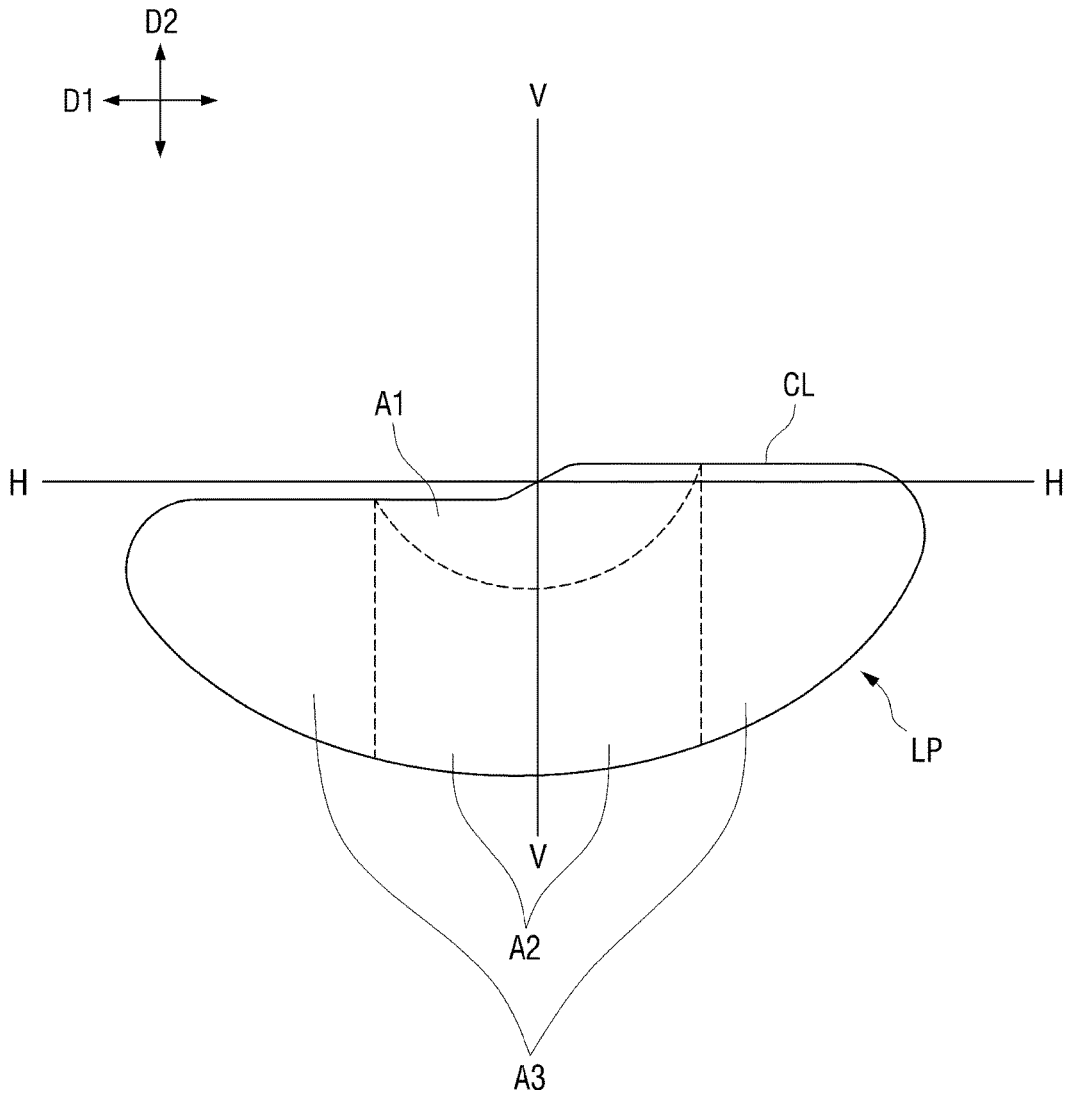
FIG. 10 is a view illustrating an example of a low beam pattern having a cut-off line in which left and right top ends have different heights on the basis of a line V-V.

FIG. 10 is a view illustrating an example of a low beam pattern LP having a cut-off line CL in which left and right top ends have different heights with respect to a line V-V. Referring to FIG. 10, particularly, in the case of the low beam pattern LP formed by a headlamp, it may be necessary to form a beam pattern in which an overall shape of the beam pattern for providing a driver with an adequate field of vision is widened to be parallel to the line H-H which horizontally passes a front focal point of the headlamp.

Further, in a high illuminance area A1 disposed to be adjacent to the cut-off line CL, relatively high brightness may be necessary to provide a driver with distant visibility for safe driving during nighttime driving. In spread areas A2 and A3, relatively low brightness may be necessary to provide a wide visibility angle (e.g., range) with respect to a short distance.

The lamp 1 according to some exemplary embodiments of the present disclosure may include the combination of the first to third micro incident/exit units with respect to the incident/exit area such that an optimal low beam pattern LP which satisfies light distribution performance requirements in consideration of light distribution properties of the above-described low beam pattern LP is formed.

In particular, each of the first to third micro incident/exit units 510, 520, and 530 according to some exemplary embodiments of the present disclosure may include a combination of one cylinder lens, which extends in the first direction parallel to the line H-H, and the plurality of micro exit lenses 310 arranged in the direction in which the cylinder lens extends.

Specifically, the lamp 1 according to some exemplary embodiments of the present disclosure may form the beam pattern which satisfies the light distribution performance requirements by adjusting the combination and arrangement of the first to third micro incident/exit units 510, 520, and 530, which form the incident/exit area. Here, the light distribution performance of the formed beam pattern may include brightness (e.g., illuminance, luminance, or luminous intensity, etc.), beam width, light efficiency, and the like of a particular region of the beam pattern.

Figure 11A:
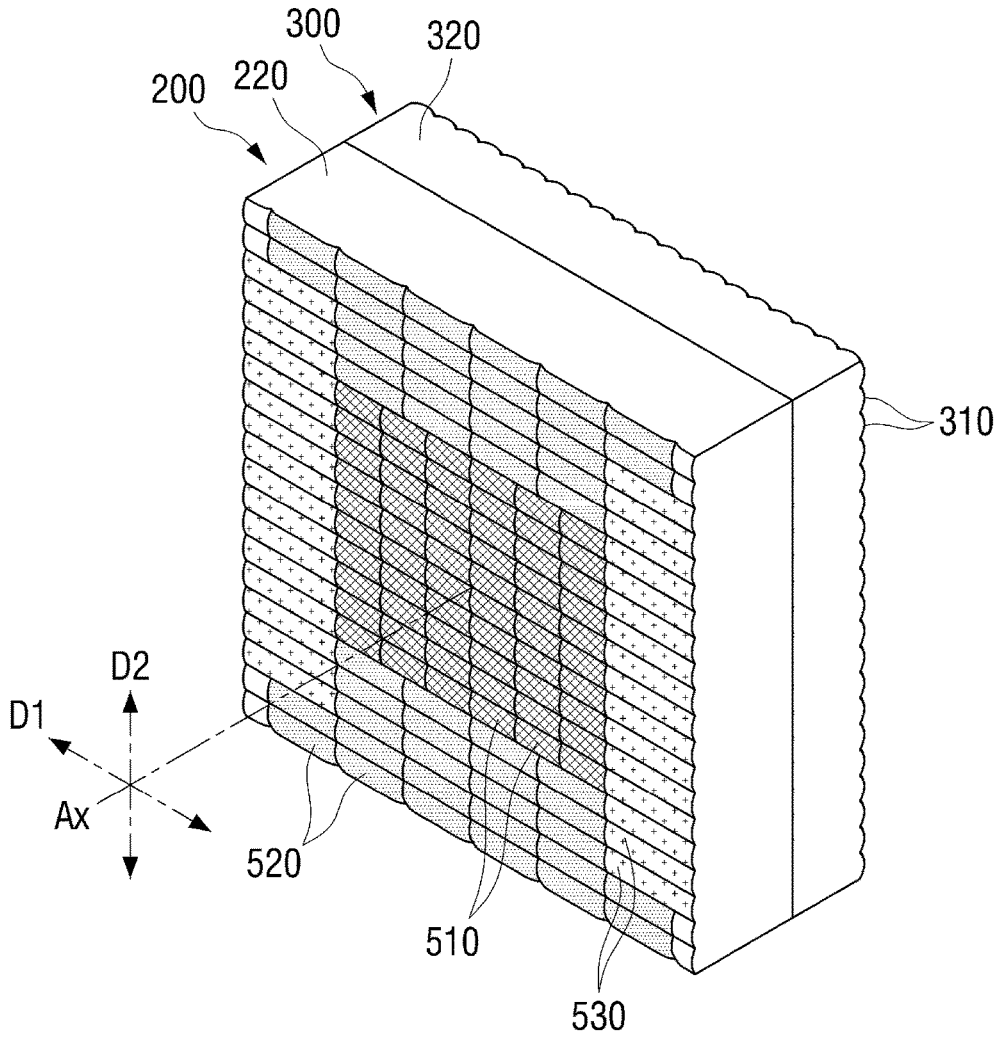
FIG. 11A is a view illustrating a combination and arrangement of the first to third micro incident/exit units which form an incident/exit area of the lamp according to some exemplary embodiments of the present disclosure, viewed from a direction in which micro incident lenses are formed.

FIG. 11A is a view illustrating the combination and arrangement of the first to third micro incident/exit units 510, 520, and 530, which form the incident/exit area of the lamp 1 according to some exemplary embodiments of the present disclosure, viewed from a direction in which the micro incident lenses 210 are formed.

Referring to FIG. 11A, the lamp 1 according to some exemplary embodiments of the present disclosure may form an optimal low beam pattern LP when the micro incident/exit units 510 are arranged in an optical axis area, the second micro incident/exit units 520 are symmetrically arranged in the second direction D2 with respect to the optical axis Ax, and the third micro incident/exit units 530 are symmetrically arranged in the first direction D1 with respect to the optical axis Ax.

As described above, since the first direction D1 of the first to third micro incident/exit units 510, 520, and 530 may be disposed to be parallel to the line H-H, the beam pattern which is widened to be parallel to the horizontal line H-H such as the low beam pattern LP shown in FIG. 10 may be formed.

More particularly, since the high illuminance area A1 located to be adjacent to the cut-off line CL may be disposed to be adjacent to the optical axis Ax and require relatively high brightness, the first micro incident/exit units 510, which form a beam pattern with relatively high brightness and a narrow beam width, may be arranged in the optical axis area.

In the spread areas A2 and A3, since relatively low brightness is required and it may be necessary to form a wide beam width, the second and third micro incident/exit units 520 and 530 which have relatively low brightness and form a beam pattern with a wide beam width may be combined and arranged.

Referring to FIG. 10, since a first spread area A2 may be formed to have a relatively narrow beam width than that of the beam pattern of a second spread area A3, the second micro incident/exit units 520 which form a beam pattern with a relatively narrow beam width may be arranged in the first spread area A2 and the third micro incident/exit units 530 which form a relatively wider beam width may be arranged in the second spread area A3.

In other words, compared to when the cylinder lenses which extend in length in the first direction are simply arranged in the second direction D2, when an incident/exit surface is configured to be divided by the combination and arrangement of the first to third micro incident/exit units 510, 520, and 530 as in the lamp 1 according to some exemplary embodiments of the present disclosure, the beam pattern having a more condensed and higher brightness may be formed in the high illuminance area A1 and an optimal low beam pattern LP which is diffused with a relatively wider beam width and lower brightness may be formed in the spread areas A2 and A3.

FIGS. 11A to 11D are views illustrating configurations in which only the first to third micro incident/exit units 510, 520, and 530 are arranged in the incident/exit area of the lamp 1 according to some exemplary embodiments of the present disclosure, viewed from the direction in which the micro incident lenses 210 are formed.

Figure 11B:
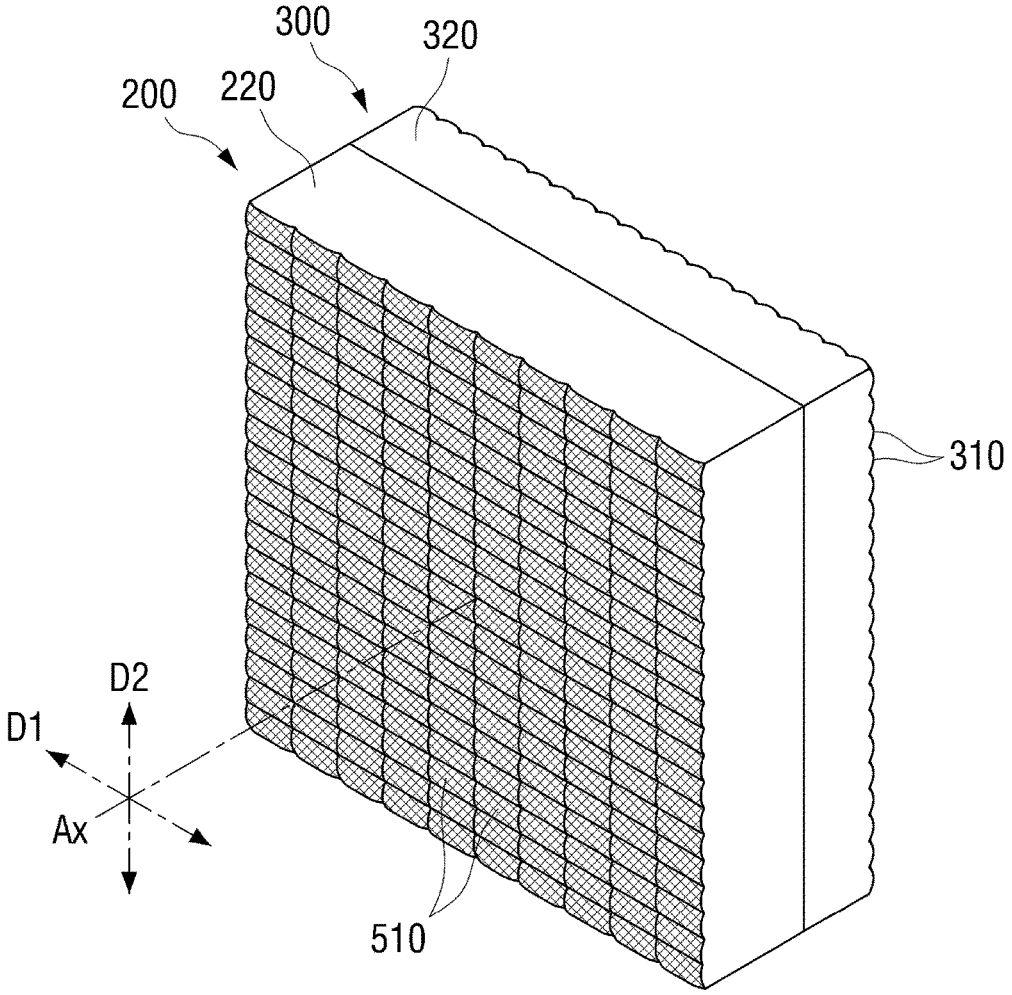
FIGS. 11B to 11D are views illustrating a configuration in which only the first to third micro incident/exit units are arranged in the incident/exit area of the lamp according to some exemplary embodiments of the present disclosure, viewed from a direction in which the micro incident lenses are formed.
Figure 11C:
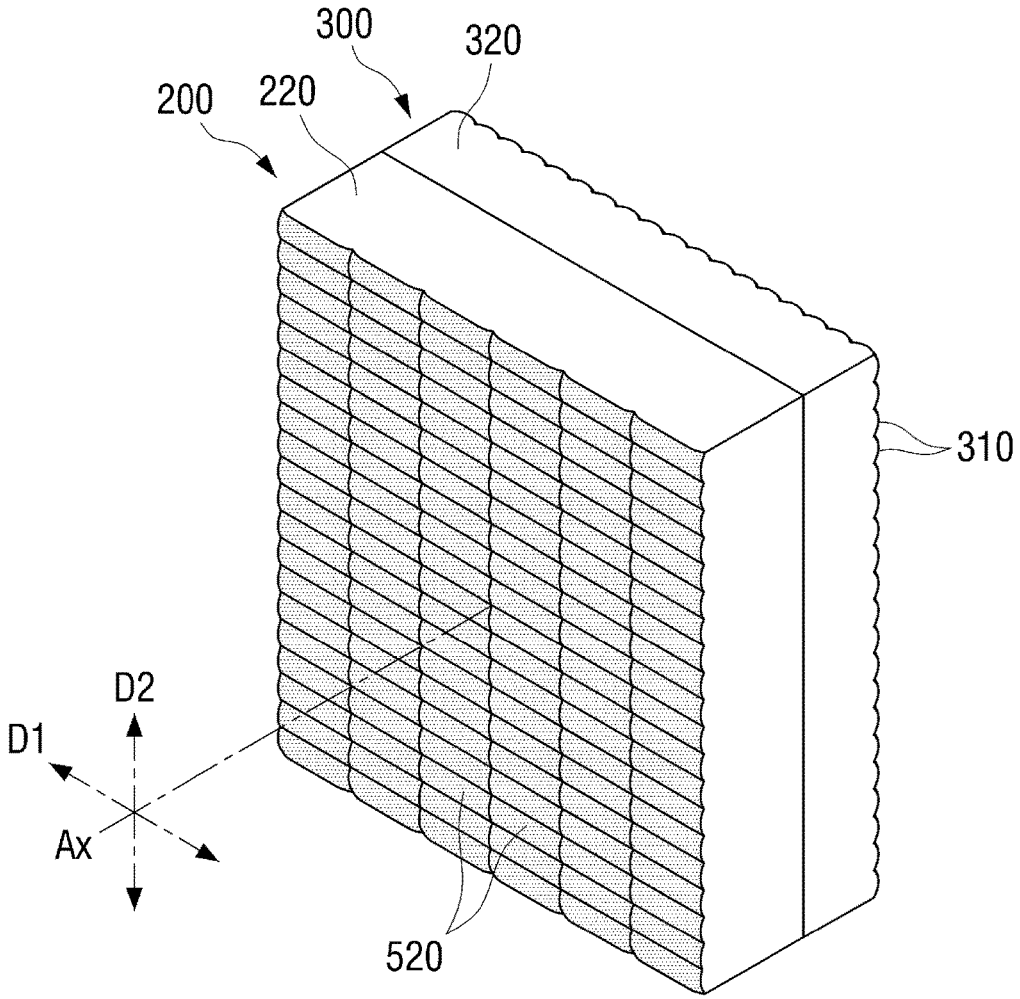
Figure 11D:
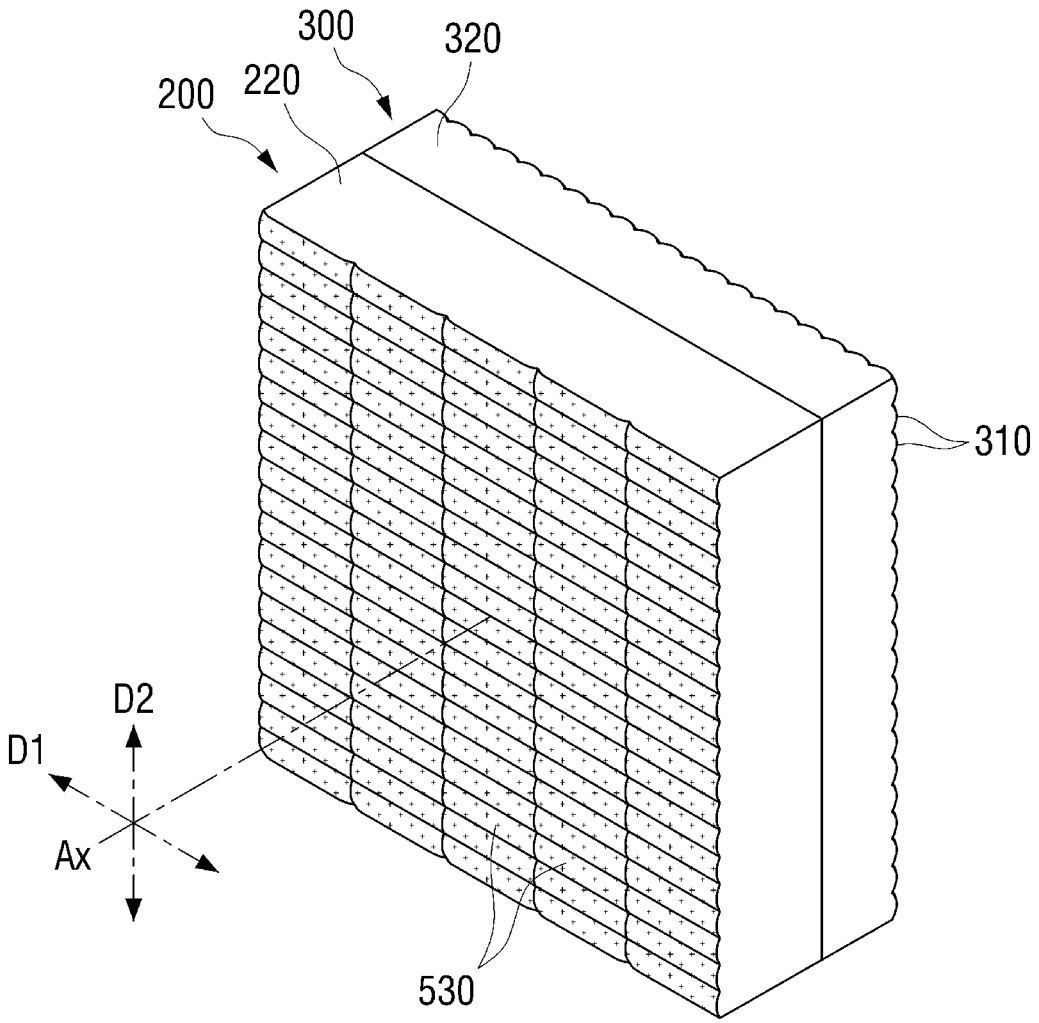

Referring to FIGS. 11B to 11D, the incident/exit area of the lamp 1 according to some exemplary embodiments of the present disclosure may be configured using exclusively the first micro incident/exit units 510, the second micro incident/exit units 520, or the third micro incident/exit units 530. FIGS. 11B to 11D are merely examples, and the combination and arrangement of the micro incident/exit units which form the incident/exit area of the lamp 1 according to some exemplary embodiments of the present disclosure are not limited thereto.

Although the above-described micro incident/exit units according to some exemplary embodiments of the present disclosure have been described with an example in which each of the plurality of micro incident lenses 210 is the cylinder lens, on the other hand, according to other exemplary embodiments of the present disclosure, each of the plurality of micro exit lenses 310 may be a semicylindrical cylinder lens which extends lengthwise in the first direction D1 and the plurality of micro exit lenses 310 may be arranged in the second direction D2 perpendicular to the first direction D1. In other words, according to other exemplary embodiments of the present disclosure, in the first to third micro incident/exit units 510, 520, and 530, the plurality of micro incident lenses 210 arranged in the first direction D1 may be combined with the cylinder lenses which extend in length in the first direction D1 corresponding thereto as the micro exit lenses 310.

Figure 12:
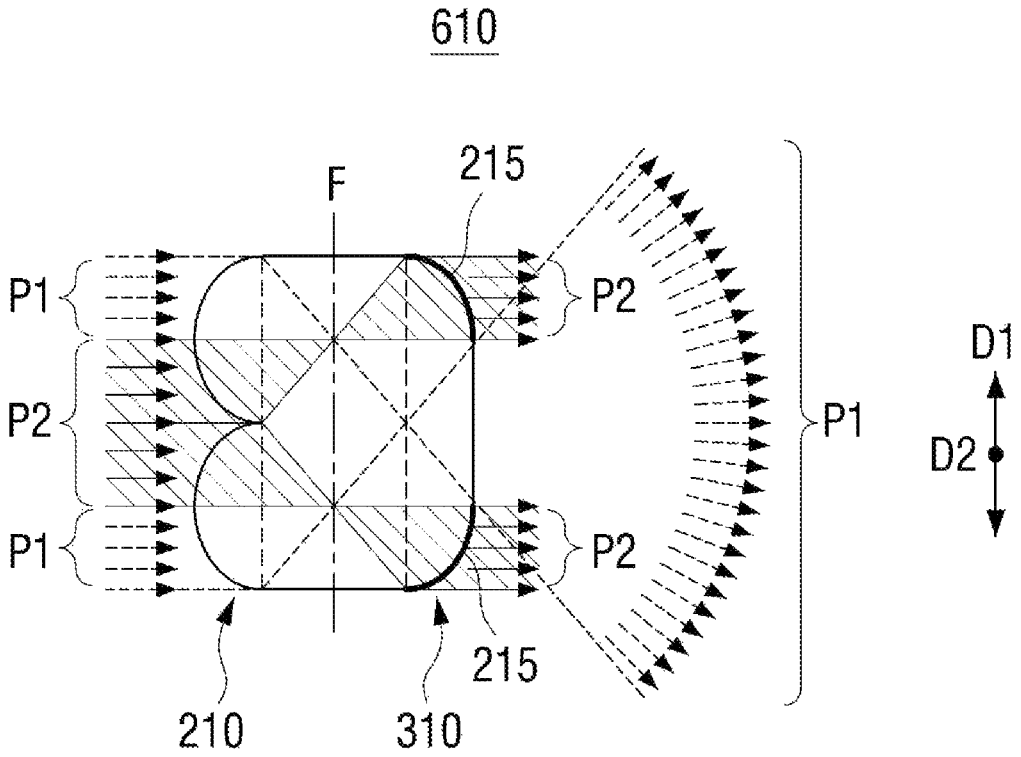
FIGS. 12 to 14 are views illustrating first to third micro incident/exit units and light-proceeding paths with respect to a first direction according to other exemplary embodiments of the present disclosure.
Figure 13:
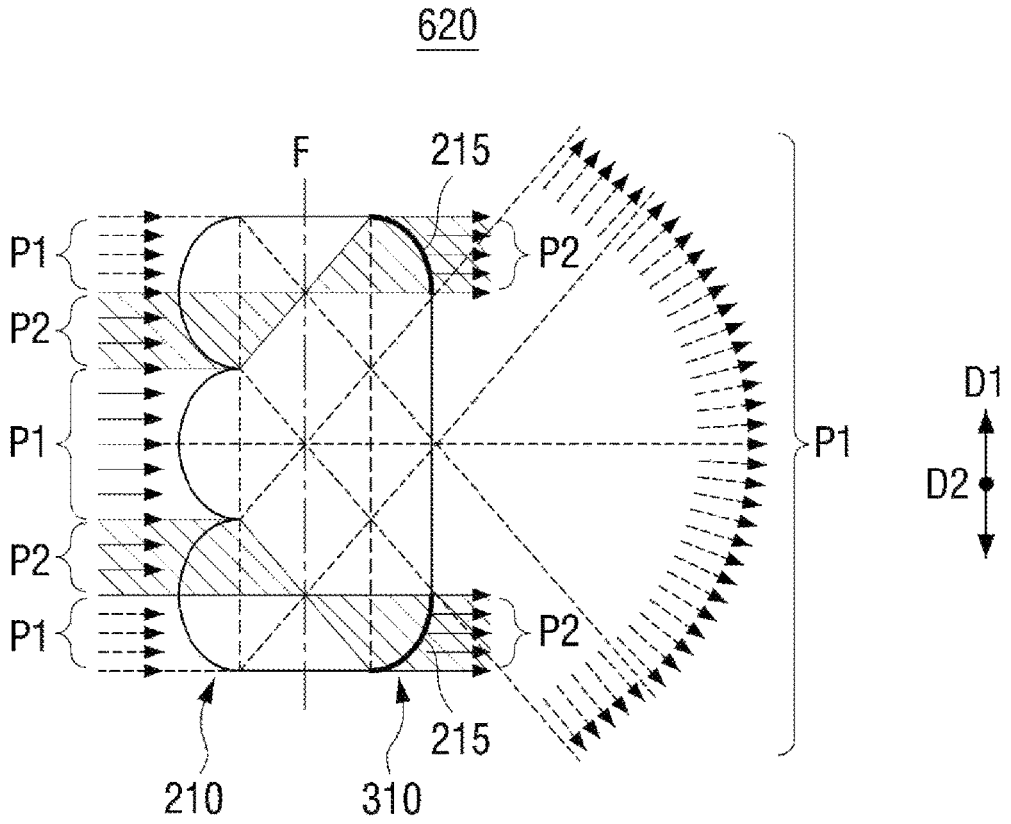
Figure 14:
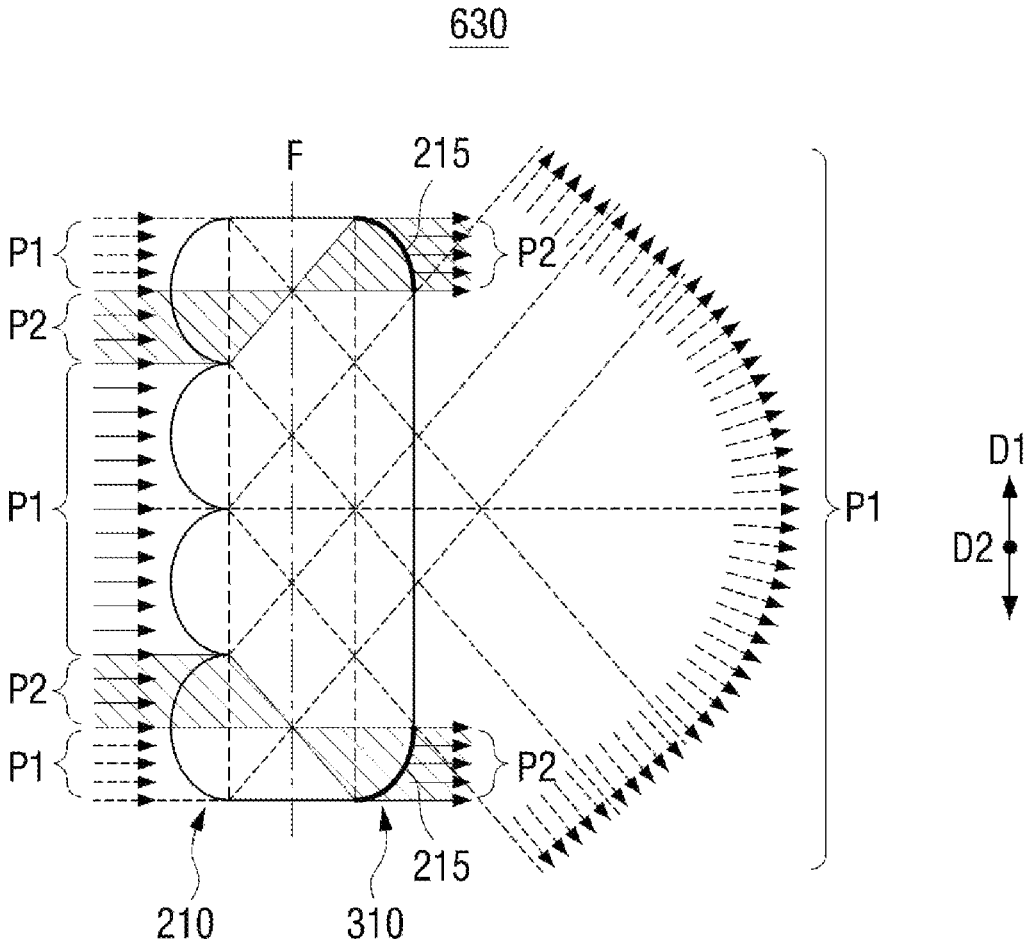

FIGS. 12 to 14 are views illustrating first to third micro incident/exit units 610, 620, and 630 and light-proceeding paths with respect to the first direction D1 according to other exemplary embodiments of the present disclosure. Referring to FIGS. 12 to 14, according to other exemplary embodiments of the present disclosure, the first micro incident/exit unit 610 may include two micro incident lenses 210 combined with one cylinder lens, the second micro incident/exit unit 620 may include three micro incident lenses 210 combined with one cylinder lens, and the third micro incident/exit unit 630 may include four micro incident lenses 210 combined with one cylinder lens, in which the cylinder lenses may perform as the micro exit lenses 310.

Referring to FIGS. 12 to 14, according to other exemplary embodiments of the present disclosure, in the micro incident/exit units 610, 620, and 630, the light which is generated by the light source portion 100 and is incident onto and exits from the plurality of micro incident lenses 210 may be incident onto the one cylinder lens combined as the micro exit lens 310 with the plurality of micro incident lenses 210.

As described above, the light which is incident onto and exits from the cylinder lens may form a beam pattern which is widened in the first direction D1 and may form a beam pattern which is narrowed in the second direction D2.

Referring to FIGS. 12 to 14 for a first beam pattern P1 shown therein, the first beam pattern P1 which is incident from the light guide portion 120 in parallel may be refracted from an incident surface of each of the micro incident lenses 210 toward a front focal point of each of the micro incident lenses 210, may exit from an exit surface of the cylinder lens which is the micro exit lens 310, and may be subsequently widened in the first direction D1.

Further, according to other exemplary embodiments of the present disclosure, the cylinder lens, as the micro exit lens 310, may include the refraction portion 215 which is bent toward both ends of the first direction D1 and formed as an aspherical surface at the exit surface of the cylinder lens.

Referring to FIGS. 12 to 14, the refraction portion 215 may refract a path of a second beam pattern P2 which is a portion of light which is incident from the micro incident lens 210 from the exit surface of the cylinder lens toward the first direction D1 such that the second beam pattern P2 may be refracted and proceed to exit to be parallel to the optical axis Ax.

As described above, the light which is incident onto and exits from the cylinder lens may form the beam pattern which is narrowed in the second direction D2. Referring back to FIG. 9, according to other exemplary embodiments of the present disclosure, since the micro exit lens 310 may be the cylinder lens which extends in the first direction D1, a semicircular cross section may be formed in the second direction D2 and the first and second beam patterns P1 and P2 which are incident from the micro incident lens 210 through the front focal point F thereof may form a beam pattern which is narrowed at the exit surface of the cylinder lens in the second direction D2.

Focal distances of the micro incident lens 210 and the cylinder lens or curvatures of the micro incident lens 210 and the cylinder lens with respect to the second direction D2 may be equally formed. However, when the focal distance of the micro incident lens 210 is longer than the focal distance of the cylinder lens or the curvature of the cylinder lens is greater than that of the micro incident lens 210, the first and second beam patterns P1 and P2 may form the beam pattern which is narrowed in the second direction D2.

Figure 15:
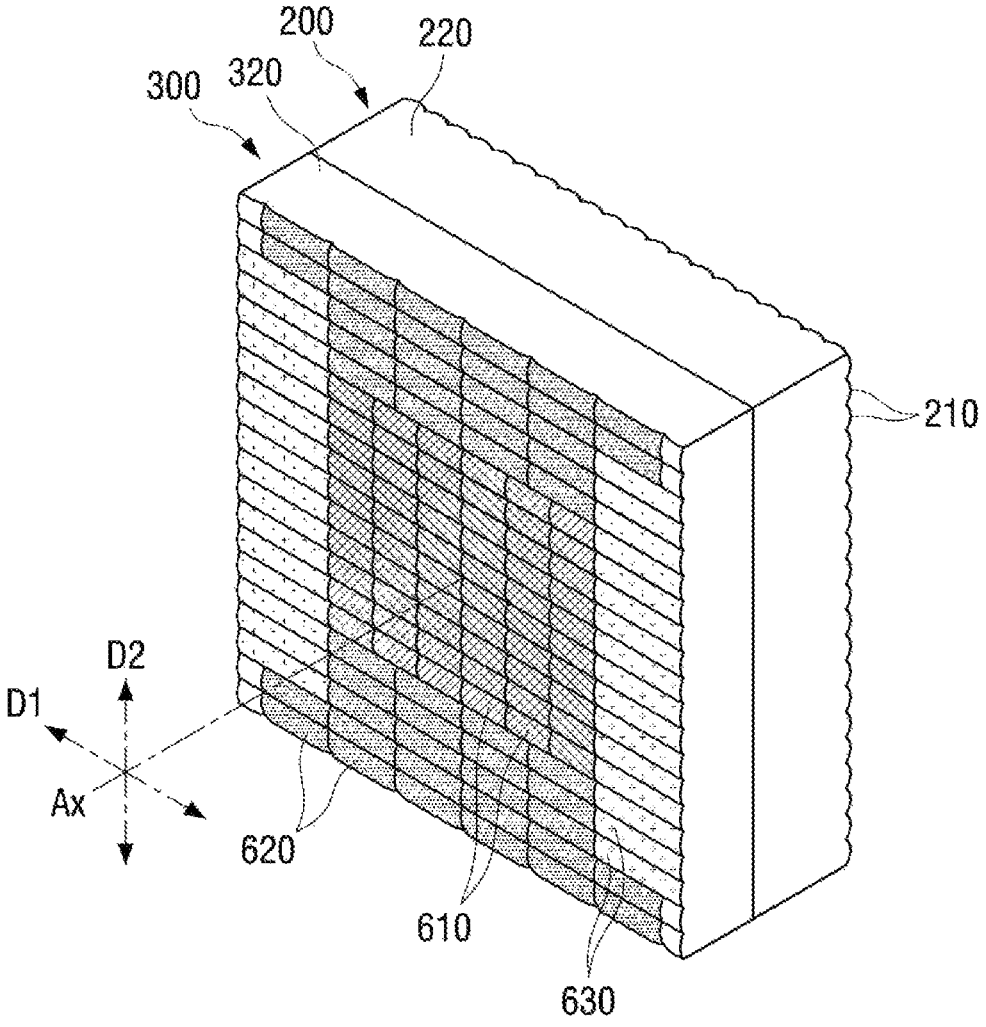
FIG. 15 is a view illustrating a combination and arrangement of the first to third micro incident/exit units which form an incident/exit area of the lamp according to other exemplary embodiments of the present disclosure, from a direction in which micro exit lenses are formed.

Accordingly, the lamp 1 according to some exemplary embodiments of the present disclosure may form a beam pattern which is widened in the first direction D1 and narrowed in the second direction D2 by using a combination of the first to third micro incident/exit units 510, 520, and 530. According to other exemplary embodiments of the present disclosure, when the first to third micro incident/exit units 610, 620, and 630 are combined and arranged in the incident/exit area of the lamp 1 according to FIG. 15 viewed from the direction in which the micro exit lens 310 is formed, a beam pattern, which further is narrowed and has high brightness, may be formed in the high illuminance area A1 of FIG. 10 and a low beam pattern LP which is widened with a relatively wider beam width while forming lower brightness may be formed in the spread areas A2 and A3.

Meanwhile, the shielding portion 400 may be disposed between the first lens portion 200 and the second lens portion 300 and obstruct a portion of light which is incident onto the second lens portion 300 from the first lens portion 200 to form a cut-off line CL of the beam pattern.

In some exemplary embodiments of the present disclosure, since the lamp 1 may be a headlamp and form the low beam pattern, the shielding portion 400 may form the cut-off line CL as shown in FIGS. 4 and 5.

The shielding portion 400 may include a plurality of shields 410 which are configured to shield a portion of light which is incident onto each of the plurality of micro exit lenses 310.

A top end of each of the plurality of shields 410 may be proximate to a focal point F on a rear side of each of the plurality of micro exit lenses 310 and obstruct a portion of light which is incident onto each of the plurality of exit lenses 310 such that the cut-off line CL, as described with reference to FIG. 10, may be formed.

The plurality of shields 410 may be fixed to and formed on a surface of the second light transmission portion 320, which faces the first lens portion 200, through deposition, coating, or adhesion thereon.

In addition, in some exemplary embodiments of the present disclosure, since each of the plurality of micro incident lenses 210 may be the cylinder lens, some of the plurality of shields 410, which obstruct a portion of light which exits from any one of the plurality of micro incident lenses 210, may be integrally formed as a single body in the direction in which the cylinder lens extends. However, the present disclosure is not limited thereto, and each of the plurality of shields 410 may be separately formed and disposed.

In summary, the lamp 1 according to some exemplary embodiments of the present disclosure may form the beam pattern which satisfies light distribution performance requirements such as brightness, beam width, and light efficiency of a particular region of the beam pattern by adjusting the combination and arrangement of the first to third micro incident/exit units 510, 520, and 530, which form the incident/exit area.

Particularly, when the first micro incident/exit units 510 are arranged in the optical axis area, the second micro incident/exit units 520 may be symmetrically arranged in the second direction D2 with respect to the optical axis Ax, and the third micro incident/exit units 530 may be symmetrically arranged in the first direction D1 with respect to the optical axis Ax in the incident/exit area of the lamp 1 according to some exemplary embodiments of the present disclosure, a low beam pattern LP, which has a shape widened to be parallel overall to the horizontal line H-H, has relatively high brightness in the high illuminance area A1, and has relatively low brightness in the spread areas A2 and A3, may be formed.

According to the exemplary embodiments of the present disclosure, a lamp for a vehicle may provide one or more effects as follows.

Any one of a micro incident lens or a micro exit lens may be a cylinder lens, and a beam pattern, in which the light incident onto the cylinder is widened to be parallel to a line H-H, may be formed such that the costs for configuring micro incident lenses and micro exit lenses arranged to be parallel to a line H-H may be reduced in comparison to configuring general micro lenses.

The beam pattern may satisfy the requirements for the light distribution performance by adjusting a combination and arrangements of incident/exit units which form an incident/exit area of a lamp for a vehicle.

Effects of the present disclosure will not be limited to the above-mentioned effects and other unmentioned effects will be clearly understood by those skilled in the art from the following claims.

It should be understood by one of ordinary skill in the art that the present disclosure can be embodied in other specific forms without changing the technical concept and essential features of the present disclosure. Therefore, the above-described embodiments should be understood to be exemplary and not limiting in every aspect. The scope of the present disclosure will be defined by the following claims rather than the above detailed description, and all changes and modifications derived from the meaning and the scope of the claims and equivalents thereof should be understood as being included in the scope of the present disclosure.

What is claimed is:

1. A lamp for a vehicle, comprising:

a light source portion;

a first lens portion which includes a plurality of micro incident lenses onto which light generated by the light source portion is incident; and a second lens portion which includes a plurality of micro exit lenses disposed adjacent to the plurality of micro incident lenses along an optical axis of the lamp, wherein a micro incident/exit unit is defined by a combination of at least one of the plurality of micro incident lenses and at least one of the plurality of micro exit lenses, wherein the lamp is configured to form a beam pattern using a combination of one or more micro incident/exit units, wherein each of the micro incident/exit units includes one cylinder lens which extends in a first direction and a plurality of corresponding lenses that correspond to the one cylinder lens, wherein any one of the micro incident lens and the micro exit lens is the cylinder lens and the other is the corresponding lens, wherein when the cylinder lens is the micro incident lens, an incident surface thereof includes a refraction portion which is bent at both ends of the first direction, wherein when the cylinder lens is the micro exit lens, an exit surface thereof includes a refraction portion which is bent at both ends of the first direction, and wherein light which is incident onto or exits from the refraction portion is narrowed in the first direction.

2. The lamp of claim 1, wherein the plurality of corresponding lenses are arranged in the first direction in which the cylinder lens extends, wherein when the cylinder lens is the micro incident lens, light which exits from the cylinder lens is incident onto the corresponding lens, and wherein when the cylinder lens is the micro exit lens, light which exits from the corresponding lens exits toward the cylinder lens.

3. The lamp of claim 1, wherein light which exits from the lamp forms a beam pattern which is widened in the first direction.

4. The lamp of claim 1, wherein light which exits from the lamp forms a beam pattern which is narrowed in a second direction perpendicular to the first direction.

5. The lamp of claim 1, wherein at least two micro incident/exit units of a same configuration, in which the one cylinder lens is combined with a same number of the corresponding lenses, are arranged adjacently.

6. The lamp of claim 1, wherein first micro incident/exit units include the one cylinder lens combined with two corresponding lenses, and wherein the first micro incident/exit units are arranged in an optical axis area to increase a brightness of a high illuminance region of the beam pattern.

7. The lamp of claim 1, wherein micro incident/exit units in which the one cylinder lens is combined with the three or more corresponding lenses, are arranged outside an optical axis area and form a spread region of the beam pattern.

8. The lamp of claim 1, wherein the one cylinder lens is combined with an N number of the corresponding lenses, and wherein the micro incident/exit units comprise:

first micro incident/exit units of which the N number is 2;

second micro incident/exit units of which the N number is 3; and third micro incident/exit units of which the N number is 4.

9. The lamp of claim 8, wherein the first micro incident/exit units are arranged in an optical axis area to increase a brightness of a high illuminance region of the beam pattern.

10. The lamp of claim 8, wherein the second micro incident/exit units are symmetrically arranged in a second direction perpendicular to the first direction with respect to an optical axis to form a portion of a spread region of the beam pattern.

11. The lamp of claim 8, wherein the third micro incident/exit units are symmetrically arranged in the first direction with respect to an optical axis to form a portion of a spread region of the beam pattern.

12. The lamp of claim 1, wherein the first lens portion includes the plurality of micro incident lenses formed on a surface of a first transmission portion, which faces the light source portion, wherein the second lens portion includes the plurality of micro exit lenses formed on a surface of a second light transmission portion, from which light exits, and wherein the first light transmission portion and the second light transmission portion are disposed such that mutually facing surfaces abut each other.

13. The lamp of claim 1, further comprising a shielding portion which includes a plurality of shields disposed on rear focal points of the plurality of micro exit lenses to obstruct a portion of light which is incident onto the plurality of micro exit lenses.

14. The lamp of claim 13, wherein a plurality of shields which obstruct a portion of light which is incident onto the plurality of micro exit lenses are disposed on and fixed to a surface of the second light transmission portion which faces the first light transmission portion.

15. The lamp of claim 12, wherein the first light transmission portion has a thickness corresponding to a focal distance of the micro incident lens, and wherein the second light transmission portion has a thickness corresponding to a focal distance of the micro exit lens.

16. The lamp of claim 1, wherein the light source portion comprises:

a light source; and a light guide portion configured to guide the light generated by the light source to the first lens portion by adjusting an optical path of the light to be parallel to an optical axis of the light source, and wherein the light guide portion is one of a Fresnel lens and a collimator lens.

17. The lamp of claim 1, wherein at least two of the micro incident/exit units have different numbers of the plurality of corresponding lenses that correspond to the one cylinder lens.

18. A lamp for a vehicle, comprising:

a light source portion;

a first lens portion which includes a plurality of micro incident lenses onto which light generated by the light source portion is incident; and a second lens portion which includes a plurality of micro exit lenses disposed adjacent to the plurality of micro incident lenses along an optical axis of the lamp, wherein a micro incident/exit units is defined by a combination of at least one of the plurality of micro incident lenses and at least one of the plurality of micro exit lenses, wherein the lamp is configured to form a beam pattern using a combination of one or more micro incident/exit units, wherein each of the micro incident/exit units includes one cylinder lens which extends in a first direction and a plurality of corresponding lenses that correspond to the one cylinder lens, wherein any one of the micro incident lens and the micro exit lens is the cylinder lens and the other is the corresponding lens, and wherein first micro incident/exit units include the one cylinder lens combined with two corresponding lenses, and the first micro incident/exit units are arranged in an optical axis area to increase a brightness of a high illuminance region of the beam pattern.

19. The lamp of claim 18, wherein micro incident/exit units in which the one cylinder lens is combined with three or more corresponding lenses are arranged outside an optical axis area and form a spread region of the beam pattern.

20. The lamp of claim 18, wherein the one cylinder lens is combined with an N number of the corresponding lenses, and wherein the micro incident/exit units comprise:

the first micro incident/exit units of which the N number is 2;

second micro incident/exit units of which the N number is 3; and third micro incident/exit units of which the N number is 4.

21. The lamp of claim 20, wherein the second micro incident/exit units are symmetrically arranged in a second direction perpendicular to the first direction with respect to an optical axis to form a portion of a spread region of the beam pattern.

22. The lamp of claim 20, wherein the third micro incident/exit units are symmetrically arranged in the first direction with respect to an optical axis to form a portion of a spread region of the beam pattern.

* * * * *